US009108419B2

(12) United States Patent
Chen et al.

(10) Patent No.: US 9,108,419 B2
(45) Date of Patent: Aug. 18, 2015

(54) METHOD FOR CONTROLLING INK CARTRIDGE CHIP, INK CARTRIDGE CHIP AND INK CARTRIDGE

(71) Applicant: APEX MICROELECTRONICS COMPANY LIMITED, Zhuhai (CN)

(72) Inventors: Hao Chen, Zhuhai (CN); Weichen Liu, Zhuhai (CN)

(73) Assignee: Apex Microelectronics Company Limited, Guangdong (CN)

( * ) Notice: Subject to any disclaimer, the term of this patent is extended or adjusted under 35 U.S.C. 154(b) by 0 days.

(21) Appl. No.: 13/958,496

(22) Filed: Aug. 2, 2013

(65) Prior Publication Data

US 2014/0139584 A1 May 22, 2014

(30) Foreign Application Priority Data

Nov. 22, 2012 (CN) ..... 2012 1 0519186
Feb. 1, 2013 (CN) ..... 2013 1 0042468

(51) Int. Cl.
*B41J 2/175* (2006.01)

(52) U.S. Cl.
CPC ..... *B41J 2/17546* (2013.01)

(58) Field of Classification Search
CPC ..... B41J 2/17543
See application file for complete search history.

(56) References Cited

U.S. PATENT DOCUMENTS 5,318,597 A * 6/1994 Hauck et al. ..... 607/20
6,351,621 B1 2/2002 Richards et al. ..... 399/111
7,232,209 B2 * 6/2007 Asauchi ..... 347/86
7,286,249 B2 10/2007 Engel ..... 358/1.14
2004/0150705 A1 8/2004 Kitabatake et al. ..... 347/134
2004/0203413 A1 10/2004 Harumoto ..... 455/66.1
2011/0216112 A1 * 9/2011 Ogawa et al. ..... 347/7

FOREIGN PATENT DOCUMENTS

CN 101596810 B 9/2012
CN 102744970 A 10/2012
EP 1 190 859 A2 3/2002
EP 1 857 285 A2 11/2007
JP 2002-14870 A 1/2002

(Continued)

OTHER PUBLICATIONS

The extended European Search Report of corresponding European Application No. 13 17 9119, dated Apr. 11, 2014.

(Continued)

*Primary Examiner* — Shelby Fidler
(74) *Attorney, Agent, or Firm* — J.C. Patents

(57) ABSTRACT

The present invention provides a method for controlling an ink cartridge chip, the ink cartridge chip and an ink cartridge. The ink cartridge chip comprises an interface unit and a control unit, wherein the interface unit is connected to an image forming apparatus and used for receiving a light control instruction sent by the image forming apparatus; the light control instruction includes a light-on instruction used for indicating the illumination of a light-emitting unit on the ink cartridge chip; and the control unit is used for controlling whether to execute the light control instruction according to the state of the ink cartridge chip when the interface unit receives the light control instruction, and updating the state of the ink cartridge chip according to the light control instruction. The present invention also provides a corresponding control method and an ink cartridge.

25 Claims, 9 Drawing Sheets

(56) References Cited

FOREIGN PATENT DOCUMENTS

| | | | |
|---|---|---|---|
| JP | 2005-205886 | A | 8/2005 |
| WO | WO 00/43932 | | 7/2000 |
| WO | WO 2013097705 | A1 * | 7/2013 |

OTHER PUBLICATIONS

Japanese Examination Report of corresponding Japan patent application No. 2013-185729, dated Sep. 24, 2013.

* cited by examiner

METHOD FOR CONTROLLING INK CARTRIDGE CHIP, INK CARTRIDGE CHIP AND INK CARTRIDGE

CROSS-REFERENCE TO RELATED APPLICATIONS

This application claims priority to Chinese Patent Application No. 201310042468.2, filed on Feb. 1, 2013, entitled "METHOD FOR CONTROLLING INK CARTRIDGE CHIP, INK CARTRIDGE CHIP AND INK CARTRIDGE" and Chinese Patent Application No. 201210519186.2, filed on Nov. 22, 2012, entitled "INK CARTRIDGE, INK CARTRIDGE CHIP AND CONTROLLING METHOD THEREOF", both of which are incorporated herein by reference in their entireties.

FIELD OF THE TECHNOLOGY

The present invention relates to the control technology of ink cartridge chips, in particular to a method for controlling an ink cartridge chip, the ink cartridge chip and an ink cartridge, belonging to the technical field of inkjet printing.

BACKGROUND

Inkjet image forming apparatuses are widely used in offices, and the style has become increasingly diverse. FIG. 1 illustrates the internal structure of an inkjet printer. As shown in the figure, an ink cartridge 1 is interposed into a mounting portion 200 and fixed on the mounting portion 200 through a locking fastener 105; a cavity 101 is formed by the enclosure of an ink cartridge housing 103; ink in the cavity 101 is supplied to an ink inlet 202 through an ink outlet 102 on the bottom side of the ink cartridge and conveyed to a print head 203; the ink is sprayed on a paper medium by the print head to form text and images; the ink cartridge of the printer is generally arranged on a movable carriage; and an ink cartridge chip 100 is obliquely arranged at a junction of a front side and a bottom side of the ink cartridge 1 and electrically connected with a contact part 220 of the mounting portion. As the ink cartridge chip 100 is arranged at the junction of the front side face and the bottom side face, the light emitted by a light-emitting portion 110 of the ink cartridge chip is blocked by a mounting handle 106 and the mounting portion of the ink cartridge and is hard to be seen by an eye 2 of a user and sensed by a light receiver of the printer, arranged on the front of the front side face and adjacent to the upper side face (not illustrated in the figure). Therefore, a light guide 104 is disposed on the front side face and used for guiding the light emitted by the light-emitting portion 110 on the ink cartridge chip 100 to the upper side face of the ink cartridge, so as to be seen by the user and sensed by the light receiver. FIGS. 2*a* and 2*b* illustrate the external structure of the ink cartridge chip 100. As shown in the figure, the ink cartridge chip 100 further comprises an integrated circuit 130 and a plurality of electric contacts 120 electrically connected with the printer, wherein a control unit and a storage unit are usually arranged inside the integrated circuit 130.

The inkjet printer may be provided with a plurality of ink cartridges for the convenience of long-term use or may have different colors. In order to ensure the correct mounting positions of various ink cartridges, the ink cartridge position detection technology is provided.

The ink cartridge position detection may be based on light emitting and receiving. In the prior art, in general, a light source is disposed on an ink cartridge and a light receiver is arranged inside a main body of an image forming apparatus. During the detection of the position of an ink cartridge, the ink cartridge is driven to the position which is directly opposite to the light receiver; the light source of the ink cartridge is controlled to emit light; and the light receiver receives the light and detects and records the luminous quantity. Subsequently, an adjacent ink cartridge is controlled to emit light, and the light receiver receives the light and detects and records the luminous quantity. As the receiver is directly opposite to the ink cartridge to be detected, the luminous quantity of the light received from the ink cartridge to be detected is more than that of the adjacent ink cartridge and may be more than a predetermined threshold value. Therefore, the main body of the image forming apparatus can identify that the position of the ink cartridge is correct, and the detection method of other ink cartridges is the same.

However, the ink cartridge position detection method has the defects that: in the actual manufacturing process, the manufacturing deviation tends to occur inevitably, namely the luminous quantity of the light sources on various ink cartridges cannot be strictly kept equal, the luminous quantity of the adjacent ink cartridge may be equal to or more than the luminous quantity of the ink cartridge to be detected, and thus the conclusion that the position of the ink cartridge is not correct can be obtained, and consequently the rate of false alarm of the image forming apparatus can be increased.

SUMMARY

However, the ink cartridge position detection method has the defects that: in the actual manufacturing process, the manufacturing deviation tends to occur inevitably, namely the luminous quantity of the light sources on various ink cartridges cannot be strictly kept equal, the luminous quantity of the adjacent ink cartridge may be equal to or more than the luminous quantity of the ink cartridge to be detected, and thus the conclusion that the position of the ink cartridge is not correct can be obtained, and consequently the rate of false alarm of the image forming apparatus can be increased.

In one aspect, the present invention provides an ink cartridge chip, which comprises an interface unit and a control unit, wherein the interface unit is electrically connected to an image forming apparatus and used for receiving a light control instruction sent by the image forming apparatus, in which the light control instruction includes a light-on instruction and a light-off instruction, and the light-on instruction is used for indicating the illumination of a light-emitting unit on the ink cartridge chip; and the control unit is used for controlling whether to execute the light control instruction according to the state of the ink cartridge chip when the interface unit receives the light control instruction, and updating the state of the ink cartridge chip according to the light control instruction.

In another aspect, the present invention provides an ink cartridge, which comprises the ink cartridge chip.

In still another aspect, the present invention provides a method for controlling the ink cartridge chip, which comprises the following steps of:

receiving a light control instruction sent by an image forming apparatus, in which the light control instruction includes a light-on instruction used for indicating the illumination of a light-emitting unit on the ink cartridge chip; and controlling whether to execute the light control instruction according to the state of the ink cartridge chip when receiving the light control instruction, and updating the state of the ink cartridge chip according to the light control instruction.

In the technical proposals provided by the above embodiments of the present invention, the control unit of the ink cartridge chip controls whether to execute the light control instruction according to the state of the ink cartridge chip when the interface unit receives the light control instruction, and updates the state of the ink cartridge chip according to the light control instruction. Therefore, the rate of false alarm of the image forming apparatus during the ink cartridge position detection can be effectively reduced.

DETAILED DESCRIPTION

The embodiment of the present invention may be applied to an image forming apparatus with the function of ink cartridge position detection. More specifically, an ink cartridge chip in the embodiment of the present invention at least includes an interface unit and a control unit, wherein the interface unit is electrically connected to the image forming apparatus and used for receiving a light control instruction sent by the image forming apparatus, in which the light control instruction includes a light-on instruction used for indicating the illumination of a light-emitting unit on the ink cartridge chip; and the control unit is used for controlling whether to execute the light control instruction according to the state of the ink cartridge chip when the interface unit receives the light control instruction, and updating the state of the ink cartridge chip according to the light control instruction.

More specifically, the states of the ink cartridge chip may include an executable state and a non-executable state. The control unit is used for controlling the illumination of the light-emitting unit if the ink cartridge chip is in the executable state when the interface unit receives the light-on instruction.

Figure 7A:
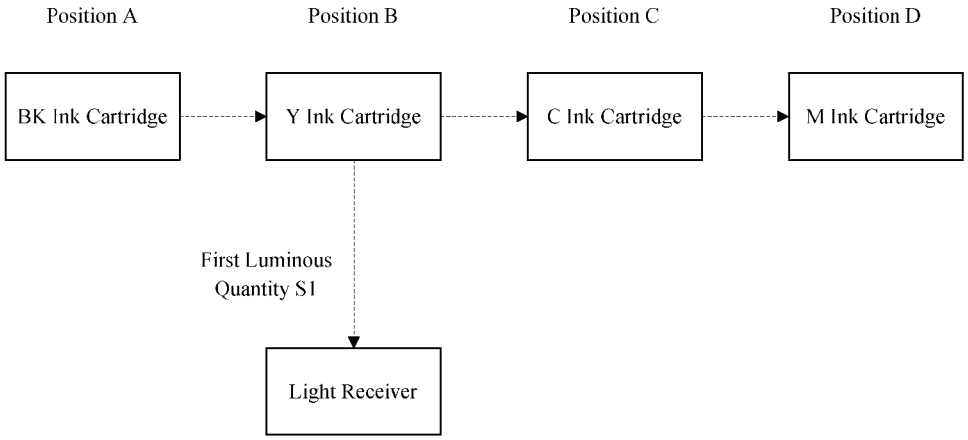
FIG. 7*a* is a schematic diagram 1 illustrating the detection principle of the ink cartridge chip in the embodiment of the present invention.
Figure 7B:
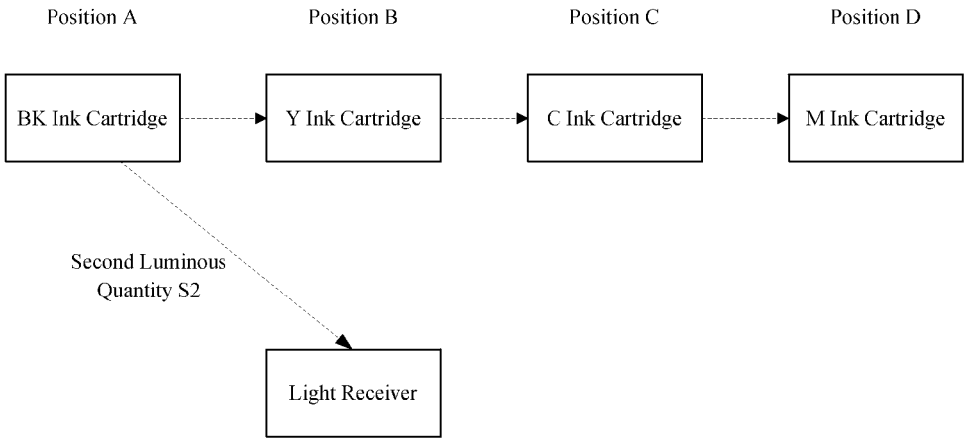
FIG. 7*b* is a schematic diagram 2 illustrating the detection principle of the ink cartridge chip in the embodiment of the present invention.

Taking an inkjet printer for example, the typical position detection proposal is as follows:

In order to ensure the normal printing of the inkjet printer and prevent the phenomenon of print errors due to the mounting of ink cartridges at incorrect positions, whether the ink cartridges are correctly mounted at appropriate positions in the inkjet printer must be detected generally after the ink cartridges are mounted into the printer. FIGS. 7*a* and 7*b* are schematic diagrams illustrating the ink cartridge position detection principles applicable to the embodiment of the present invention. As shown in FIG. 7*a*, supposing that the inkjet printer is provided with four ink cartridges, for clear distinction, colors are used for distinguishing the ink cartridges, and the four ink cartridges are respectively marked as a black ink cartridge BK, a yellow ink cartridge Y, a cyan ink cartridge C and a magenta ink cartridge M. Each ink cartridge is respectively mounted at a corresponding ink cartridge mounting position, and the respective correct positions of the ink cartridges are, as shown in FIG. 7*a*, respectively positions A, B, C and D. In addition, a light receiver is fixedly arranged on the inkjet printer. The position of the ink cartridge is changed by the movement of a carriage, so that the relative position between a light-emitting unit on the ink cartridge and the light receiver on the printer can be changed.

The position detection mainly includes the directly opposite position detection of the current ink cartridge to be detected and the adjacent luminous quantity detection of an adjacent ink cartridge. Each ink cartridge in the image forming apparatus must be taken as the ink cartridge to be detected and detected one by one. The directly opposite position detection process refers to that: the printer actuates the light-emitting unit of the ink cartridge to be detected opposite to the light receiver to emit light, and detects whether the luminous quantity received by the light receiver is more than a default value. The adjacent luminous quantity detection process refers to that: the ink cartridge to be detected is driven to maintain at a position opposite to the light receiver, and the printer drives a light-emitting unit of any ink cartridge adjacent to the ink cartridge to be detected to emit light and detects whether the luminous quantity received by the light receiver at this point is less than the luminous quantity received during the directly opposite position detection. As illustrated in FIG. 7*a*, as for the ink cartridge Y to be detected, the ink cartridge Y may be moved to be directly opposite to the light receiver; a light-emitting unit of the ink cartridge Y to be detected is controlled to emit light; the light receiver receives the light, acquires a first luminous quantity S1, and determines whether the first luminous quantity is more than a predetermined threshold value; and if so, the directly opposite position detection of the ink cartridge to be detected is correct. As illustrated in FIG. 7*b*, the position of the ink cartridge is kept unchanged; a light-emitting unit of an adjacent ink cartridge BK of the ink cartridge Y to be detected is controlled to emit light; the light receiver receives the light, acquires a second luminous quantity S2, and determines whether the first luminous quantity is more than the second luminous quantity; and if so, the adjacent luminous quantity detection of the ink cartridge Y to be detected is correct. In reverse, the directly opposite position detection or the adjacent luminous quantity detection is determined to be incorrect. The position of the ink cartridge can only be deemed to be correct after the two detection processes. As described above, an ink cartridge to be detected should be construed as an ink cartridge subjected to the directly opposite position detection and an adjacent ink cartridge should be construed as any ink cartridge adjacent to the ink cartridge to be detected.

Figure 1:
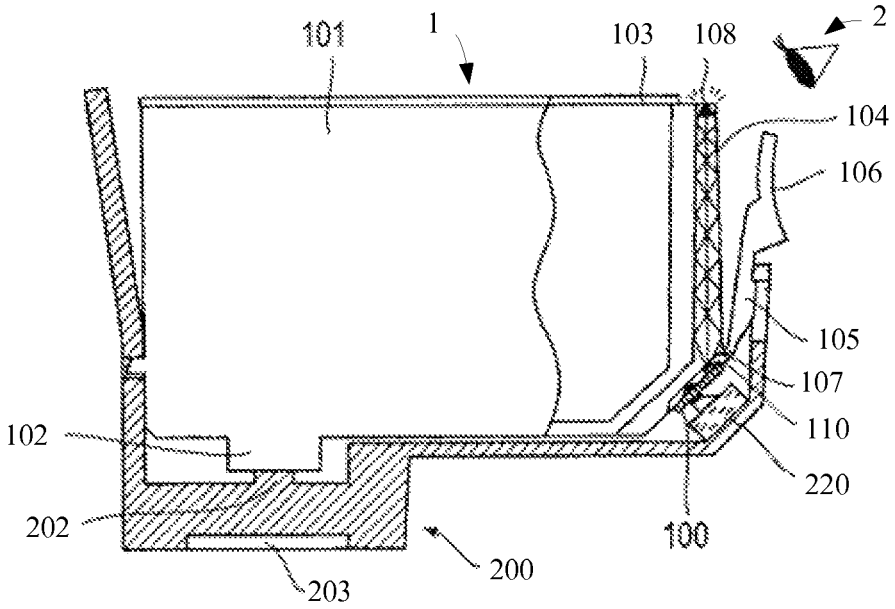
FIG. 1 is an internal structure diagram of an inkjet printer in the prior art.
Figure 2A:
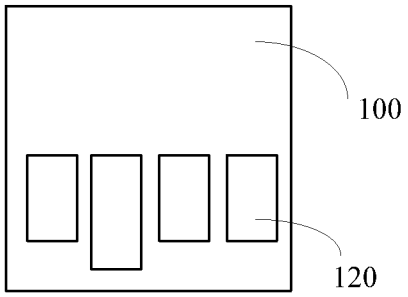
FIG. 2*a* is a schematic structural view 1 of an ink cartridge chip in the prior art.
Figure 2B:
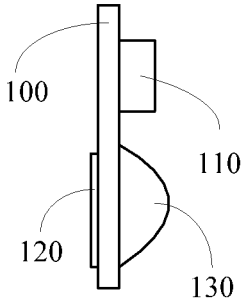
FIG. 2*b* is a schematic structural view 2 of the ink cartridge chip in the prior art.
Figure 3:
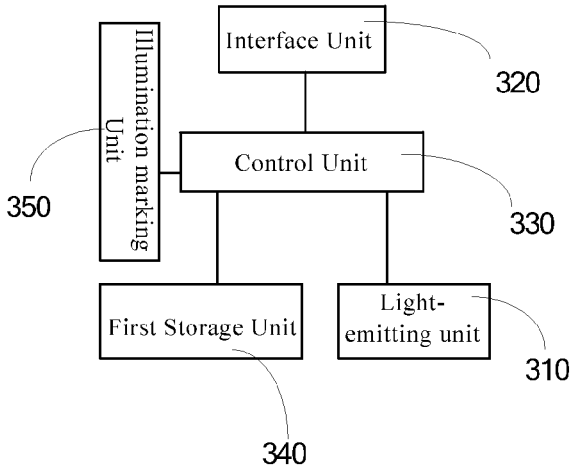
FIG. 3 is a schematic structural view 1 of an ink cartridge chip in an embodiment of the present invention.

The structure of a first ink cartridge chip provided by the embodiment of the present invention is as shown in FIG. 3. The first ink cartridge chip comprises an interface unit 320, a control unit 330, a first storage unit 340, an illumination marking unit 350 and a light-emitting unit 310, wherein the first storage unit 340 is used for storing ink cartridge identification information; the illumination marking unit 350 is provided with an illuminating flag used for indicating whether the ink cartridge chip is in the executable state or the non-executable state; and the control unit 330 is used for illuminating a light-emitting unit according to a light-on instruction when the illuminating flag indicates the executable state and not executing the light-on instruction when the illuminating flag indicates the non-executable state.

The interface unit is electrically connected to an image forming apparatus and is used for receiving a light control instruction sent by the image forming apparatus, and the light control instruction includes the light-on instruction and a light-off instruction. The light control instruction at least includes ink cartridge identification information and control information, wherein the ink cartridge identification information is used for indicating an ink cartridge of a specified type, and the control information is used for indicating whether to illuminate or turn off the light-emitting unit. In addition, the connection between the interface unit and the image forming apparatus may be wired or wireless.

Information related to an image forming cartridge, such as the ink cartridge identification information, the manufacturer, the production date, the ink usage amount, the remaining ink amount and the like, is stored into the first storage unit, wherein the ink cartridge identification information may be ink color information and may also be a device address of the storage unit or other information capable of distinguishing different types of ink cartridges. The storage unit may adopt a commonly used non-volatile memory such as an electrically programmable read only memory (EPROM), an electrically erasable programmable read only memory (EEPROM), a flash memory (FLASH), a ferroelectric memory, a phase change memory and the like and may also adopt the proposal of a volatile memory and a power supply source, for example, a static random access memory (SRAM) and a battery or a capacitor, and a dynamic random access memory (DRAM) and a battery or a capacitor.

The illumination marking unit is provided with the illuminating flag used for indicating the control unit whether to execute the operation of illuminating the light-emitting unit. The illumination marking unit may be independently arranged and may also be arranged inside the control unit or the storage unit. The default state of the illuminating flag is to indicate that the control unit can execute the operation of illuminating the light-emitting unit. When predetermined external triggering conditions are satisfied, the illuminating flag may be changed into the non-executable state which is used for indicating the control unit to not execute the operation of illuminating the light-emitting unit (i.e., the operation of disabling the operation of illuminating the light-emitting unit). It is equivalent that the light-emitting unit is locked and in the off state.

The control unit is used for processing the light control instruction received by the interface unit and illuminating or turning off the light-emitting unit according to the control information of the light control instruction and the state of the illumination marking unit.

More specifically, when the interface unit receives the light-on instruction, the control unit determines whether the illuminating flag is changed into the non-executable state, controls the illumination of the light-emitting unit if not, and does not execute the operation of illuminating the light-emitting unit or locks the ink cartridge chip or does not receive the instruction again if so. Moreover, in view of different response speeds of different control units, when the control unit determines that the illuminating flag has not been changed into the non-executable state, the light-emitting unit can be controlled for direct illumination or controlled for illumination after the delay for a plurality of clock cycles.

Moreover, the control unit controls and changes the state of the illuminating flag according to the predetermined triggering conditions. More specifically, when the ink cartridge identification information in the light-on instruction or the light-off instruction received by the interface unit is related to the ink cartridge identification information stored into the first storage unit, the control unit changes the illuminating flag to indicate the non-executable state.

In the embodiment of the present invention, "the ink cartridge identification information in the received light-on instruction is related to the ink cartridge identification information stored into the storage unit" refers to that the two types of ink cartridge identification information are matched or consistent with each other or have specified relation, for example, the same value is respectively recorded by hex and octal.

In addition, the control unit is used for changing the illuminating flag to indicate the non-executable state when the ink cartridge identification information in the received light-on instruction is related to the ink cartridge identification information stored into the first storage unit and the time length between the received light-on instruction and a subsequently received light control instruction is verified to be more than or equal to a first threshold value. That is to say, the control unit may also determine whether to change the state of the illuminating flag according to the time length between different light control instructions received by the interface unit. More specifically, the control unit also initiates a first timer after receiving a light control instruction, stops the first timer and initiates a second timer when receiving the next light control instruction, stops the second timer when receiving another light control instruction, . . . and the like. When determining that the ink cartridge identification information in the received light-on instruction is related to the ink cartridge identification information stored into the storage unit, the control unit waits for a control instruction resulting in the conclusion that the timing time is more than or equal to the first threshold value. When determining that the timing time of the lately stopped timer is more than or equal to the first threshold value, the control unit changes the illuminating flag to indicate the non-executable state.

Moreover, the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when the time length between the received light-on instruction and a subsequently received light control instruction is verified to be more than or equal to the first threshold value, or else, changing the illuminating flag back to indicate the executable state. That is to say, the control unit may also determine whether to maintain the changed state of the illuminating flag according to the time length between different light control instructions received by the interface unit. In addition, the control unit also initiates a first timer after receiving a light control instruction, stops the first timer and initiates a second timer when receiving the next light control instruction, stops the second timer when receiving another light control instruction, . . . and the like. When the control unit determines that the ink cartridge identification information in the received light-on instruction is related to the ink cartridge identification information stored into the storage unit and hence changes the illuminating flag to indicate the non-executable state, the control unit waits for a control instruction resulting in the conclusion that the timing time is more than or equal to the first threshold value, maintains the non-executable state of the illuminating flag only when determining that the timing time of the latterly stopped timer is more than or equal to the first threshold value, and changes the state of the illuminating flag back to the executable state when the timing time of the latterly stopped timer is less than the first threshold value.

Furthermore, the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when determining that the time length between a previously received light-off instruction and a subsequently received light-off instruction is more than or equal to the second threshold value, or else, changing the illuminating flag back to indicate the executable state. That is to say, the control unit may also determine whether to maintain the changed state of the illuminating flag according to the time length between different light-off instructions received by the interface unit. In addition, the control unit also initiates a third timer after receiving a light-off instruction, stops the third timer and initiates a fourth timer when receiving the next light-off instruction, stops the fourth timer when receiving another light-off instruction, . . . and the like. When determining that the ink cartridge identification information in the received light-on instruction is related to the ink cartridge identification information stored into the storage unit and hence changing the illuminating flag to indicate the non-executable state, the control unit waits for a control instruction resulting in the conclusion that the timing time is more than or equal to the second threshold value, maintains the non-executable state of the illuminating flag only when determining that the timing time of the lately stopped timer is more than or equal to the second threshold value, and changes the state of the illuminating flag back to indicate the executable state when the timing time of the lately stopped timer is less than the second threshold value.

The state of the illuminating flag is changed back to be executable when the ink cartridge chip receives the power supplied by the image forming apparatus again each time, or the non-executable state is removed when the image forming apparatus stops supplying power to the ink cartridge chip or when the light control instruction with the specified ink cartridge identification information is received. The specified ink cartridge identification information refers to the ink cartridge identification information of the last illuminated ink cartridge chip during the position detection.

In the present invention, the first threshold value is less than or equal to the second threshold value which is between 100 and 300 ms.

In various embodiments of the present invention, the light-emitting unit is taken as a module and arranged on the ink cartridge chip. Of course, the light-emitting unit may also be not arranged on the ink cartridge chip but connected to the control unit through a connecting member. More specifically, the connecting member may be a wire or an electrical contact point and may also adopt the wireless mode. The light-emitting unit is an electroluminescent member, and more specifically, may be a light-emitting diode (LED), a laser diode, a fluorescent lamp, a tungsten lamp and the like, and will not be limited herein. The light emitted by the light-emitting unit may be visible or invisible.

Moreover, the embodiment of the present invention also provides a second ink cartridge chip. The structure of the second ink cartridge chip is consistent with that of the first ink cartridge chip, that is, the second ink cartridge chip also includes an interface unit, a control unit, a first storage unit, an illumination marking unit and a connecting member connected to a light-emitting unit. The functions of various units are basically similar and will not be described further herein. The main difference is that predetermined triggering conditions of an illuminating flag in the illumination marking unit are different from that of the first ink cartridge chip.

In the embodiment, the control unit is used for controlling and changing the state of the illuminating flag according to the predetermined triggering conditions. More specifically, the control unit changes the illuminating flag to indicate the non-executable state when determining that two such light control instructions are accumulatively received by the interface unit and the ink cartridge identification information in the two light control instructions is respectively related to the ink cartridge information stored into the first storage unit.

"The ink cartridge identification information in the light control instructions is related to the ink cartridge identification information stored into the first storage unit" refers to that the two types of ink cartridge identification information are matched or consistent with each other, or have specified relation, for example, the same value is respectively recorded by hex or octal.

Moreover, the control unit is used for changing the illuminating flag to indicate the non-executable state when the ink cartridge information in two accumulatively received light control instructions is respectively related to the ink cartridge identification information stored into the first storage unit and the time length between the two received light control instructions is more than or equal to the first threshold value. That is to say, the control unit may also determine whether to change the state of the illuminating flag according to the time length between different light control instructions received by the interface unit. More specifically, the control unit also initiates a first timer after receiving a light control instruction, stops the first timer and initiates a second timer when receiving the next light control instruction, stops the second timer when receiving another light control instruction, . . . and the like. In addition, the control unit changes the illuminating flag to indicate the non-executable state only when determining that the timing time of the lately stopped timer is more than or equal to the first threshold value after determining that two light control instructions, in which the ink cartridge identification information in the two light control instructions is respectively related to the ink cartridge identification information stored into the first storage unit, are accumulatively received.

Furthermore, the control unit is used for changing the illuminating flag to indicate the non-executable state when the ink cartridge information in two accumulatively received light control instructions is respectively related to the ink cartridge identification information stored into the first storage unit and the time length between the second received light control instruction and the previously received light-off instruction is more than or equal to the second threshold value. That is to say, the control unit may also determine whether to change the state of the illuminating flag according to the time length between different light-off instructions received by the interface unit. In addition, the control unit also initiates a third timer after receiving a light-off instruction, stops the third timer and initiates a fourth timer when receiving the next light-off instruction, stops the fourth timer when receiving another light-off instruction, . . . and the like. Moreover, the control unit changes the illuminating flag to indicate the non-executable state only when the timing time of the lately stopped timer is more than or equal to the second threshold value after determining that two light control instructions, in which the ink cartridge identification information in the two light control instructions is respectively related to the ink cartridge identification information stored into the storage unit, are accumulatively received.

The illuminating flag restores the default state when the ink cartridge chip receives the power supplied by the image forming apparatus each time, and the non-executable state is removed when the image forming apparatus stops supplying power to the ink cartridge chip or the light control instruction with the specified ink cartridge identification information is received. The specified ink cartridge identification information is the ink cartridge identification information of the last illuminated ink cartridge chip during the position detection.

It can be known by comparing the first and second ink cartridge chips that: the illumination marking unit in the present invention is equivalent to a counter with a stop value, and the counter is used for counting the frequency of the control unit in determining that the ink cartridge identification information in the light control instruction is related to the ink cartridge identification information stored into the storage unit. The counter prevents the light-emitting unit from emitting light when the count value of the first ink cartridge chip is 1, and as the stop value is 1, no value can be added subsequently. When the count value of the second ink cartridge chip is 2, the counter may prevent the light-emitting unit from emitting light, and as the stop value is 2, no value can be added subsequently. The reasons are as follows: partial light-off instructions are for all the ink cartridge chips and hence do not carry the ink cartridge identification information; partial light-off instructions are for specified ink cartridge chips and hence carry the ink cartridge identification information, and appear in pair with the light-on instructions. Therefore, the illumination marking unit (or the counter) of the present invention may be implemented by a specific hardware circuit or a computer program, and other components of the ink cartridge chips may be also partially implemented by computer programs.

In the embodiment, the light-emitting unit is taken as a module and arranged on the ink cartridge chip. Of course, the light-emitting unit may also be not arranged on the ink cartridge chip but connected to the control unit through a connecting member. More specifically, the connecting member may be a wire or an electrical contact point and may also adopt the wireless mode.

It should be understood by those skilled in the art that the light-emitting unit in various embodiments of the present invention may be arranged at a position directly opposite to the light receiver and may also be arranged at a position deviated from the light receiver. In the later case, an optical guide member is used for guiding the light to the light receiver.

The embodiment of the present invention also provides a third ink cartridge chip. In the embodiment, the state of the ink cartridge chip is the instruction receiving state of the ink cartridge chip. The structure of the third ink cartridge chip is basically consistent with that of the first ink cartridge chip and also includes an interface unit, a control unit and a connecting member connected to a light-emitting unit. The functions of various units are basically similar and will not be described further herein. The main differences are that: the ink cartridge chip in the embodiment further includes an instruction receiving statistical unit used for the statistics of the instruction receiving state of a light control instruction received by the ink cartridge chip; and the control unit is used for controlling whether to execute the light control instruction according to the instruction receiving state when the interface unit receives the light control instruction, and updating the instruction receiving state stored into the instruction receiving statistical unit according to the light control instruction.

In the above embodiments of the present invention, the instruction receiving statistical unit may be used for storing the light-on instruction or the ink cartridge identification information in the light control instruction received by the interface unit. In addition, the instruction receiving statistical unit may be independently arranged and may also be arranged inside the control unit or the storage unit. The stored light control instruction or the stored ink cartridge identification information is removed when the ink cartridge chip receives the power supplied by the image forming apparatus each time, or when the image forming apparatus stops supplying power for the ink cartridge chip, or when the light control instruction with specified ink cartridge identification information is received. The specified ink cartridge identification information refers to the ink cartridge identification information of the last illuminated ink cartridge chip during the position detection.

More specifically, in the embodiment of the present invention, the control unit is used for controlling the illumination of the light-emitting unit when the third threshold value is reached if the same light-on instruction or the same ink cartridge identification information is not recorded in the instruction receiving statistical unit and not executing the operation of illuminating the light-emitting unit if the same light-on instruction or the same ink cartridge identification information is recorded in the instruction receiving statistical unit, when a new light-on instruction is received; and is used for updating the instruction receiving state stored into the instruction receiving statistical unit. That is to say, when the interface unit receives the light-on instruction, the control unit initiates a fifth timer and determines whether the same light-on instruction or the same ink cartridge identification information is recorded into the instruction receiving statistical unit. If not, the control unit controls the illumination of the light-emitting unit when the fifth timer reaches the third threshold value, and records the light-on instruction or the ink cartridge identification information into the instruction receiving statistical unit. If so, the control unit does not execute the operation of illuminating the light-emitting unit. In addition, the third threshold value is less than or equal to the first threshold value and is preferably between 60 and 100 ms.

In view of different sequence and duration of the printer in sending light control instructions, the control unit may also update the instruction receiving state stored into the instruction receiving statistical unit according to the light control instructions.

Moreover, the control unit updates the instruction receiving state stored into the instruction receiving statistical unit according to the light control instructions, and more specifically, records the lately received light-on instruction or the ink cartridge identification information in a previously received light control instruction into the instruction receiving statistical unit when determining that the time length between the two successively received light control instructions is more than or equal to the first threshold value. That is to say, the control unit may also determine whether to record the light-on instruction or the ink cartridge identification information in the previously received light control instruction according to the time length between different light control instructions received by the interface unit. More specifically, the control unit also initiates a first timer after receiving a light control instruction, stops the first timer and initiates a second timer when receiving the next light control instruction, stops the second timer when receiving another light control instruction, . . . and the like. During the determination of light control instructions, the control unit waits for a light control instruction resulting in the conclusion that the timing time is more than or equal to the first threshold value. When determining that the timing time of the lately stopped timer is more than or equal to the first threshold value, the control unit records the lately received light-on instruction or the ink cartridge identification information in the previously received light control instruction, into the instruction receiving statistical unit.

Alternatively, the control unit updates the instruction receiving state stored into the instruction receiving statistical unit according to the light control instruction, and more specifically, stores the light-on instruction or the ink cartridge identification information in the light control instruction into the instruction receiving statistical unit when the received light-on instruction or the received ink cartridge identification information is not recorded in the instruction receiving statistical unit, and maintains the light-on instruction or the ink cartridge identification information recorded into the instruction receiving statistical unit this time when determining that the time length between the light-on instruction and a subsequently received light control instruction is more than or equal to the first threshold value, or else, deletes the light-on instruction or the ink cartridge identification information recorded this time. That is to say, the control unit may also determine whether to remove the light-on instruction or the ink cartridge identification information stored this time according to the time length between different light control instructions received by the interface unit. In addition, the control unit also initiates a first timer after receiving a light control instruction, stops the first timer and initiates a second timer when receiving the next light control instruction, stops the second timer when receiving another light control instruction, . . . and the like. Moreover, the control unit waits for a light control instruction resulting in the conclusion that the timing time is more than or equal to the first threshold value after determining that the received light-on instruction or the received ink cartridge identification information is not recorded in the instruction recording unit, controlling the illumination of the light-emitting unit when the fifth timer reaches the third threshold value, and recording the light control instruction or the ink cartridge identification information into the instruction recording unit. Furthermore, the control unit maintains the light-on instruction or the ink cartridge identification information recorded in the instruction recording unit only when determining that the timing time of the lately stopped timer is more than or equal to the first threshold value, and removes the recorded light-on instruction or the recorded ink cartridge identification information when the timing time of the lately stopped timer is less than the first threshold value.

Alternatively, the control unit updates the instruction receiving state stored into the instruction receiving statistical unit according to the light control instruction, and more specifically, stores the light-on instruction or the ink cartridge identification information in the light control instruction when the received light-on instruction or the received ink cartridge identification information is not recorded in the instruction receiving statistical unit, and maintains the light-on instruction or the ink cartridge identification information recorded into the instruction receiving statistical unit this time when the time length between a light-off instruction received before receiving the light-on instruction and a light-off instruction received after receiving the light-on instruction is more than or equal to the second threshold value, or else, deletes the light-on instruction or the ink cartridge identification information recorded this time. That is to say, the control unit may also determine whether to remove the light-on instruction or the ink cartridge identification information recorded this time according to the time length between different light-off instructions received by the interface unit. In addition, the control unit also initiates a third timer after receiving a light-off instruction, stops the third timer and initiates a fourth timer when receiving the next light-off instruction, stops the fourth timer when receiving another light-off instruction, . . . and the like. Moreover, the control unit waits for a light control instruction resulting in the conclusion that the timing time is more than or equal to the second threshold value after determining that the light-on instruction or the ink cartridge identification information is not recorded in the instruction recording unit, controlling the illumination of the light-emitting unit when the fifth timer reaches the third threshold value, and recording the light control instruction into the instruction recording unit. Furthermore, the control unit maintains the light-on instruction or the ink cartridge identification information recorded in the instruction recording unit only when determining that the timing time of the lately stopped timer is more than or equal to the second threshold value, and removes the light-on instruction or the ink cartridge identification information when the timing time of the lately stopped timer is less than the second threshold value.

The embodiment of the present invention also provides a fourth ink cartridge chip. The structure of the fourth ink cartridge chip is basically consistent with that of the first ink cartridge chip and also includes an interface unit, a control unit and a connecting member connected to a light-emitting unit. The functions of various units are basically similar and will not be described further herein. The main difference is that an instruction receiving statistical unit of the ink cartridge chip in the embodiment is specifically used for storing marking information respectively corresponding to the light-on instructions or the ink cartridge identification information in the light control instructions. In the specific implementation, a reference table may be stored in the chip for the one-by-one correspondence of the relations between the marking information and different light-on instructions or different ink cartridge identification information in the light control instructions, so that the corresponding marking information can be found by the search in the reference table when the chip receives the light control instructions sent by the printer, and hence whether the marking information is marked can be determined.

The instruction receiving statistical unit is used for storing marking information, whether is marked, respectively corresponding to a plurality of light-on instructions with different types of ink cartridge identification information or the ink cartridge identification information in light control instructions. The marking information is used for indicating the control unit whether to execute the operation of illuminating the light-emitting unit. The instruction receiving statistical unit may be independently arranged and may also be arranged inside the control unit or the storage unit. The stored marking information or the stored ink cartridge identification information is removed when the ink cartridge chip receives the power supplied by the image forming apparatus each time, or the stored marking information is removed when the image forming apparatus stops supplying power for the ink cartridge chip or a light control instruction with specified ink cartridge identification information is received. The specified ink cartridge identification information is the ink cartridge identification information of the last illuminated ink cartridge chip during the position detection.

In view of different sequence and duration of the light control instructions sent by the printer, the control unit may also control the instruction receiving statistical unit whether to mark the marking information of the received light-on instruction or the ink cartridge identification information according to predetermined triggering conditions.

More specifically, the control unit is used for controlling the illumination of the light-emitting unit after the third threshold value is reached if the marking information corresponding to the same light-on instruction or the same ink cartridge identification information recorded in the instruction receiving statistical unit is not marked when receiving the light-on instruction, or else, not executing the operation of illuminating the light-emitting unit; and is used for updating the instruction receiving state stored into the instruction receiving statistical unit according to the light control instruction. When the interface unit receives the light-on instruction, the control unit initiates a fifth timer and determines whether the marking information corresponding to the light-on instruction or the ink cartridge identification information thereof in the instruction receiving statistical unit is marked. If not, the control unit controls the illumination of the light-emitting unit when the fifth timer reaches the third threshold value and marks the marking information, corresponding to the light-on instruction or the ink cartridge identification information thereof, in the instruction receiving statistical unit. If so, the control unit does not execute the operation of illuminating the light-emitting unit. The third threshold value is less than or equal to the first threshold value and is preferably between 60 and 100 ms.

Moreover, the control unit updates the instruction receiving state of the instruction receiving statistical unit according to the light control instruction, and more specifically, marks the marking information corresponding to the light-on instruction lately received by the instruction receiving statistical unit or the ink cartridge identification information in the light control instruction previously received by the instruction receiving statistical unit when determining that the time length between the two successively received light control instructions is more than or equal to the first threshold value. That is to say, the control unit may also determine whether to mark the light-on instruction or the ink cartridge identification information in the light control instruction according to the time length between different light control instructions received by the interface unit. More specifically, the control unit also initiates a first timer when receiving a light control instruction, stops the first timer and initiates a second timer when receiving the next light control instruction, stops the second timer when receiving another light control instruction, . . . and the like. In addition, the control unit waits for a light control instruction resulting in the conclusion that the timing time is more than or equal to the first threshold value during the determination of light control instructions, and marks the marking information corresponding to the lately received light-on instruction or the ink cartridge identification information in the previously received light control instruction when determining that the timing time of the lately stopped timer is more than or equal to the first threshold value.

Alternatively, the control unit updates the instruction receiving state stored into the instruction receiving statistical unit according to the light control instruction, and more specifically, marks the marking information, corresponding to the light-on instruction or the ink cartridge identification information in the light control instruction, in the instruction receiving statistical unit after receiving a new light-on instruction, and maintains the marking information corresponding to the light-on instruction or the ink cartridge identification information in the light control instruction marked this time when determining that the time length between the received new light-on instruction and the lately received light control instruction is more than or equal to the first threshold value, or else, removes the marking information corresponding to the light-on instruction or the ink cartridge identification information in the light control instruction marked this time. That is to say, the control unit may also determine whether to remove the marked marking information according to the time length between different light control instructions received by the interface unit. In addition, the control unit also initiates a first timer after receiving a light control instruction, stops the first timer and initiates a second timer after receiving the next light control instruction, stops the second timer after receiving another light control instruction, . . . and the like. Moreover, the control unit controls the illumination of the light-emitting unit when the fifth timer reaches the third threshold value after determining that the marking information, corresponding to the light-on instruction or the ink cartridge identification information of the light control instruction, in the instruction receiving statistical unit is marked, and waits for a light control instruction resulting in the conclusion that the timing time is more than or equal to the first threshold value after marking the marking information, corresponding to the light-on instruction or the ink cartridge identification information of the light control instruction, in the instruction receiving statistical unit. Furthermore, the control unit maintains the information marked in the instruction receiving statistical unit only when determining that the timing time of the lately stopped timer is more than or equal to the first threshold value, and removes the marking information, corresponding to the light-on instruction or the ink cartridge identification information of the light control instruction, marked this time when the timing time of the lately stopped timer is less than the first threshold value.

The embodiment of the present invention also provides a fifth ink cartridge chip, which not only includes an interface unit and a control unit but also includes an instruction logic recording unit and a light-on state unit, wherein the light-on state unit is provided with a light-on state bit used for indicating whether the ink cartridge chip is in the executable state or the non-executable state; and the control unit is used for illuminating a light-emitting unit according to a light-on instruction when the light-on state bit indicates the executable state, and not executing the light-on instruction when the light-on state bit indicates the non-executable state, and changing the state of the light-on state bit according to receiving logics stored into the instruction logic recording unit.

More specifically, the control unit is used for changing the light-on state bit to indicate the non-executable state when determining that the successively received light control instructions are in conformity with the receiving logics stored into the instruction logic recording unit. In the embodiment of the present invention, supposing that there are four light control instructions, namely BK-ON, C-ON, M-ON and Y-ON, the logics can be set that the state change condition can be satisfied when the ink cartridge chip receives the C-ON instruction and the M-ON instruction in succession. Alternatively, different settings are provided in various different ink cartridge chips, and the condition of changing the state can be satisfied when the light control instructions indicating "on first and off then", for example, C-ON and C-OFF, are accumulatively received. Alternatively, different settings are provided in various different ink cartridge chips, and the change condition can be satisfied when the ink cartridge chip receives the Nth light control instruction of certain ink cartridge chip, for example, when the third BK-ON instruction is received.

The present invention also provides an ink cartridge for supplying ink for an inkjet image forming apparatus. The ink cartridge includes an ink outlet for supplying the ink for a printer and a housing for holding the ink. In addition, the ink cartridge further includes the ink cartridge chip with any foregoing structure or function. Moreover, the foregoing light-emitting unit may be also arranged on the ink cartridge.

Figure 4:
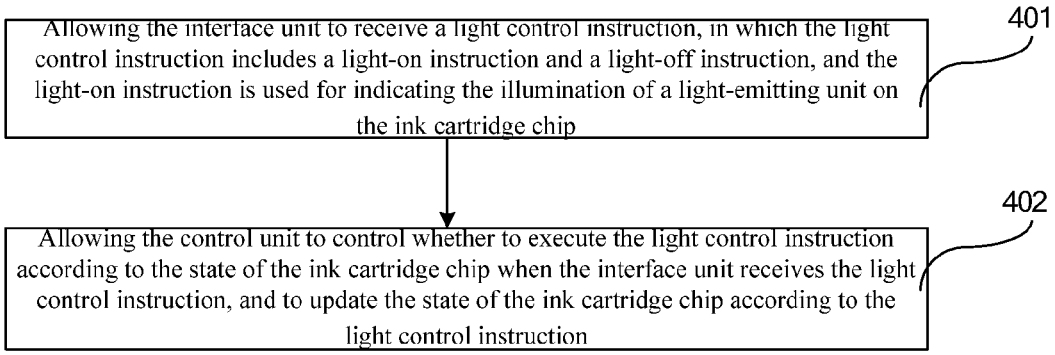
FIG. 4 is a flow diagram 1 illustrating a method for controlling the ink cartridge chip in the embodiment of the present invention.

The present invention also provides a corresponding method for controlling the ink cartridge chip. The ink cartridge chip includes an interface unit and a control unit, wherein the interface unit is electrically connected to an image forming apparatus. As illustrated in FIG. 4, the method includes the following steps of:

step 401: allowing the interface unit to receive a light control instruction sent by the image forming apparatus, in which the light control instruction includes a light-on instruction and a light-off instruction, and the light-on instruction is used for indicating the illumination of a light-emitting unit on the ink cartridge chip; and step 402: allowing the control unit to control whether to execute the light control instruction according to the state of the ink cartridge chip when the interface unit receives the light control instruction, and to update the state of the ink cartridge chip according to the light control instruction.

More specifically, the states of the ink cartridge chip include an executable state and a non-executable state. The control unit controls the illumination of the light-emitting unit if the ink cartridge chip is in the executable state when the interface unit receives the light-on instruction.

More specifically, in the embodiment of the present invention, the process of allowing the control unit to control the illumination of the light-emitting unit if the ink cartridge chip is in the executable state when the interface unit receives the light-on instruction may specifically include a variety of modes.

In one technical proposal, the ink cartridge chip further includes a first storage unit and an illumination marking unit, wherein the first storage unit is used for storing ink cartridge identification information, and the illumination marking unit is provided with an illuminating flag used for indicating whether the ink cartridge chip is in the executable state or the non-executable state. Moreover, the control unit is used for illuminating the light-emitting unit according to the light-on instruction when the illuminating flag indicates the executable state, and not executing the light-on instruction when the illuminating flag indicates the non-executable state.

The process of allowing the control unit to update the state of the ink cartridge chip according to the light control instruction includes the following step of:

allowing the control unit to change the illuminating flag to indicate the non-executable state when the ink cartridge identification information in the received light-on instruction or the received light-off instruction is related to the ink cartridge identification information stored into the first storage unit;

or allowing the control unit to change the illuminating flag to indicate the non-executable state when the ink cartridge identification information in the received light-on instruction is related to the ink cartridge identification information stored into the first storage unit and the time length between the light-on instruction and a subsequently received light control instruction is verified to be greater than or equal to the first threshold value;

or allowing the control unit to change the illuminating flag to indicate the non-executable state when the ink cartridge identification information in the received light-on instruction is related to the ink cartridge identification information stored into the first storage unit, and to maintain the illuminating flag to indicate the non-executable state when determining that the time length between the light-on instruction and a subsequently received light control instruction is greater than or equal to the first threshold value, or else, to change the illuminating flag back to the executable state;

or allowing the control unit to change the illuminating flag to indicate the non-executable state when the ink cartridge identification information in the received light-on instruction is related to the ink cartridge identification information stored into the first storage unit, and to maintain the illuminating flag to indicate the non-executable state when determining that the time length between a previously received light-off instruction and a subsequently received light-off instruction is greater than or equal to the second threshold value, or else, to change the illuminating flag back to the executable state.

As for another ink cartridge chip, the process of allowing the control unit to update the state of the ink cartridge chip according to the light control instruction includes the following step of:

allowing the control unit to change the illuminating flag to indicate the non-executable state when the ink cartridge identification information in two accumulatively received light control instructions is respectively related to the ink cartridge identification information stored into the first storage unit;

or allowing the control unit to change the illuminating flag to indicate the non-executable state when the ink cartridge identification information in two accumulatively received light control instructions is respectively related to the ink cartridge identification information stored into the first storage unit and the time length between the two received light control instructions is greater than or equal to the first threshold value;

or allowing the control unit to change the illuminating flag to indicate the non-executable state when the ink cartridge identification information in two accumulatively received light control instructions is respectively related to the ink cartridge identification information stored into the first storage unit and the time length between the subsequently received light control instruction and the previously received light-off instruction is greater than or equal to the second threshold value.

As for the third ink cartridge chip, the state of the ink cartridge chip refers to the instruction receiving state of the ink cartridge chip. The ink cartridge chip further includes an instruction receiving statistical unit used for the statistics of the instruction receiving state of the light control instruction received by the ink cartridge chip.

The control unit controls whether to execute the light control instruction according to the instruction receiving state when the interface unit receives the light control instruction, and updates the instruction receiving state stored into the instruction receiving statistical unit according to the light control instruction.

In the embodiment of the present invention, the instruction receiving statistical unit is specifically used for storing the received light-on instruction or the ink cartridge identification information in the received light control instruction.

The control unit is specifically used for controlling the illumination of the light-emitting unit when the third threshold value is reached if the same light-on instruction or the same ink cartridge identification information is not recorded in the instruction receiving statistical unit, and not executing the operation of illuminating the light-emitting unit if the same light-on instruction or the same ink cartridge identification information is recorded in the instruction receiving statistical unit, when receiving the light-on instruction; and used for updating the instruction receiving state stored into the instruction receiving statistical unit according to the light control instruction.

Moreover, the control unit updates the instruction receiving state stored into the instruction receiving statistical unit according to the light control instruction, and more specifically, records the lately received light-on instruction or the ink cartridge identification information in the previously received light control instruction into the instruction receiving statistical unit when determining that the time length between the two successively received light control instructions is greater than or equal to the first threshold value.

Alternatively, the control unit is used for updating the instruction receiving state stored into the instruction receiving statistical unit according to the light control instruction, and more specifically, is used for storing the light-on instruction or the ink cartridge identification information in the light control instruction into the instruction receiving statistical unit when the received light-on instruction or the received ink cartridge identification information is not recorded in the instruction receiving statistical unit, and maintaining the light-on instruction or the ink cartridge identification information recorded in the instruction receiving statistical unit this time when determining that the time length between the received instruction and a subsequently received light control instruction is greater than or equal to the first threshold value, or else, deleting the light-on instruction or the ink cartridge identification information recorded this time.

Alternatively, the control unit is used for updating the instruction receiving state stored into the instruction receiving statistical unit, and more specifically, is used for storing the light-on instruction or the ink cartridge identification information in the light control instruction into the instruction receiving statistical unit when the received light-on instruction or the ink cartridge identification information is not recorded in the instruction receiving statistical unit, and maintaining the light-on instruction or the ink cartridge identification information recorded in the instruction receiving statistical unit this time when determining that the time length between a light-off instruction received before receiving the light-on instruction and a light-off instruction received after receiving the light-on instruction is greater than or equal to the second threshold value, or else, deleting the light-on instruction or the ink cartridge identification information recorded this time.

Furthermore, the instruction receiving statistical unit may also be specifically used for storing the marking information corresponding to the light-on instructions or the ink cartridge identification information in the light control instructions respectively.

The control unit controls the illumination of the light-emitting unit when the third threshold value is reached if the marking information, corresponding to the same light-on instruction or the same ink cartridge identification information recorded in the instruction receiving statistical unit, is not marked, when a new light-on instruction is received, or else, does not execute the operation of illuminating the light-emitting unit; and updates the instruction receiving state stored into the instruction receiving statistical unit according to the light control instruction.

The control unit updates the instruction receiving state stored into the instruction receiving statistical unit according to the light control instruction, and more specifically, marks the marking information corresponding to the light-on instruction lately received or the ink cartridge identification information in the light control instruction previously received by the instruction receiving statistical unit when determining that the time length between the two successively received light control instructions is greater than or equal to the first threshold value.

Alternatively, the control unit is used for updating the instruction receiving state stored into the instruction receiving statistical unit according to the light control instruction, and more specifically, is used for marking the marking information, corresponding to the light-on instruction or the ink cartridge identification information in the light control instruction, in the instruction receiving statistical unit, and maintaining the marking information, corresponding to the light-on instruction or the ink cartridge identification information in the light control instruction, marked this time, when determining that the time length between the light-on instruction and the subsequently received light control instruction is greater than or equal to the first threshold value, or else, deleting the marking information, corresponding to the light-on instruction or the ink cartridge identification information in the light control instruction, marked this time.

As for the fifth ink cartridge chip, the ink cartridge chip further includes an instruction logic recording unit and a light-on state unit, wherein the instruction logic recording unit is used for storing receiving logics of different light control instructions; and the light-on state unit is provided with a light-on state bit used for indicating whether the ink cartridge chip is in the executable state or the non-executable state. Moreover, the control unit illuminates the light-emitting unit according to the light-on instruction when the light-on state bit indicates the executable state and does not execute the light-on instruction when the light-on state bit indicates the non-executable state; and changes the state of the light-on state bit according to the receiving logics stored into the instruction logic recording unit.

More specifically, the control unit changes the light-on state bit to indicate the non-executable state when determining that the successively received light control instructions are in conformity with the receiving logics stored into the instruction logic recording unit.

Figure 5:
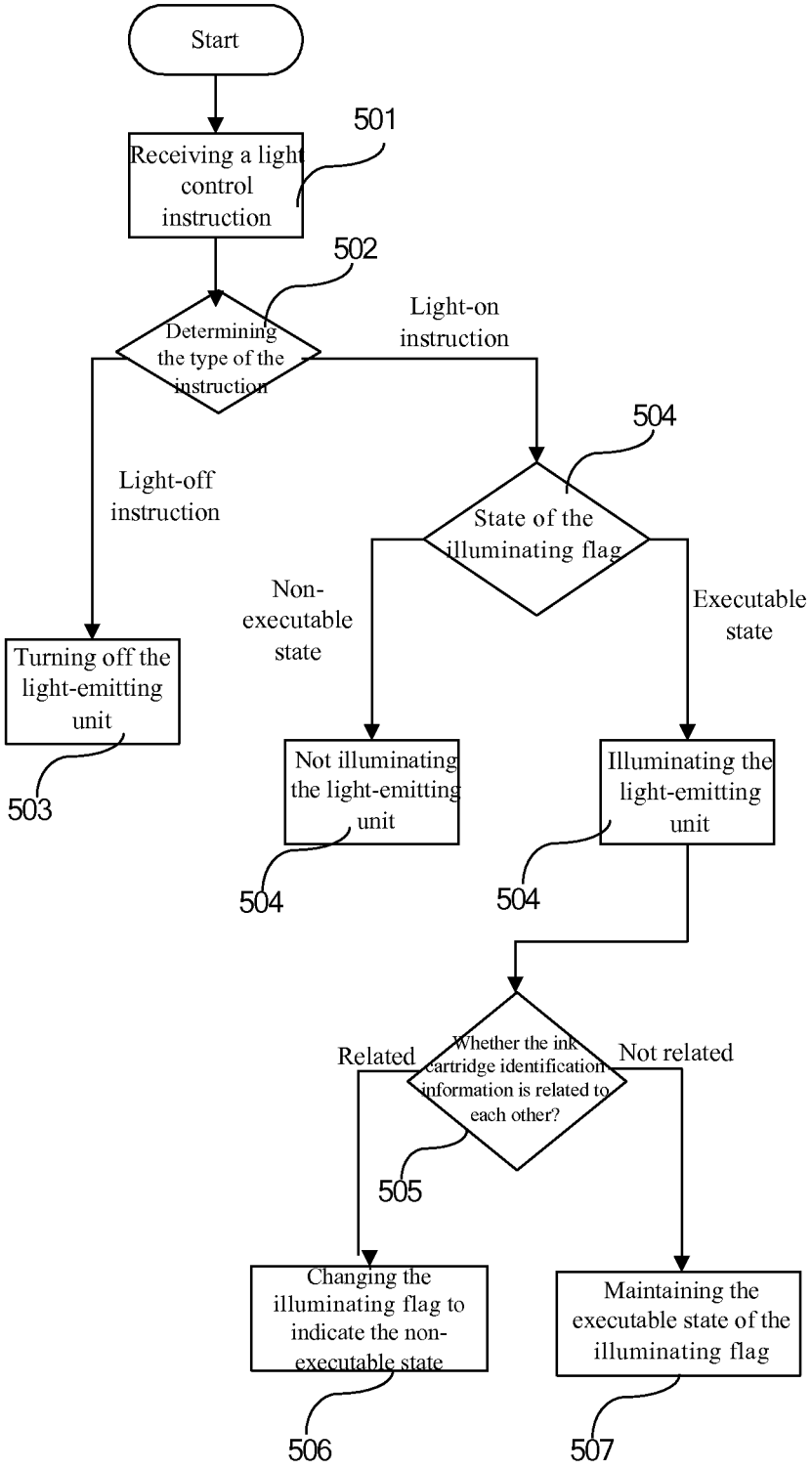
FIG. 5 is a flow diagram 2 illustrating the method for controlling the ink cartridge chip in the embodiment of the present invention.

FIG. 5 is a flow diagram 2 of the method for controlling the ink cartridge chip in the embodiment of the present invention. As illustrated in FIG. 5, the method includes the following steps of:

step 501: receiving a light control instruction;

step 502: determining the type of the instruction, namely determining whether the instruction is a light-on instruction or a light-off instruction, and executing step 504 in the case of the light-on instruction, or else, executing step 503;

step 503: turning off the light-emitting unit;

step 504: determining whether to illuminate the light-emitting unit according to the state of an illuminating flag, determining not to illuminate the light-emitting unit if the illuminating flag is in the non-executable state, and to illuminate the light-emitting unit if the illuminating flag is in the executable state;

step 505: determining whether the ink cartridge identification information is related to each other, executing step 506 if so, and executing step 507 if not;

step 506: changing the illuminating flag to indicate the non-executable state; and step 507: maintaining the executable state of the illuminating flag.

Figure 6:
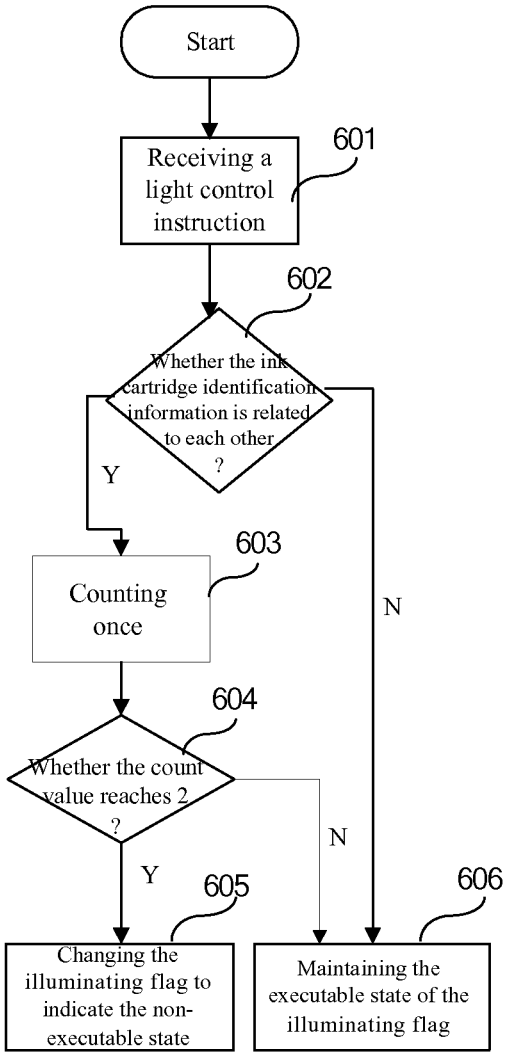
FIG. 6 is a flow diagram 3 illustrating the method for controlling the ink cartridge chip in the embodiment of the present invention.

The flow of the second ink cartridge chip in illuminating or turning off the light-emitting unit is similar to that of the first ink cartridge chip, with reference to corresponding parts in FIG. 5. FIG. 6 illustrates a different part from FIG. 5, namely the part of the second ink cartridge chip in how to change the state of the illuminating flag. The process includes the following steps of:

step 601: receiving a light control instruction;

step 602: determining whether the ink cartridge identification information is related to each other, executing step 603 if so, and executing step 606 if not;

step 603: counting once;

step 604: determining whether the count value reaches 2, executing step 605 if so, and executing step 606 if not;

step 605: changing the illuminating flag to indicate the non-executable state; and step 606: maintaining the illuminating flag to indicate the executable state.

Figure 8A:
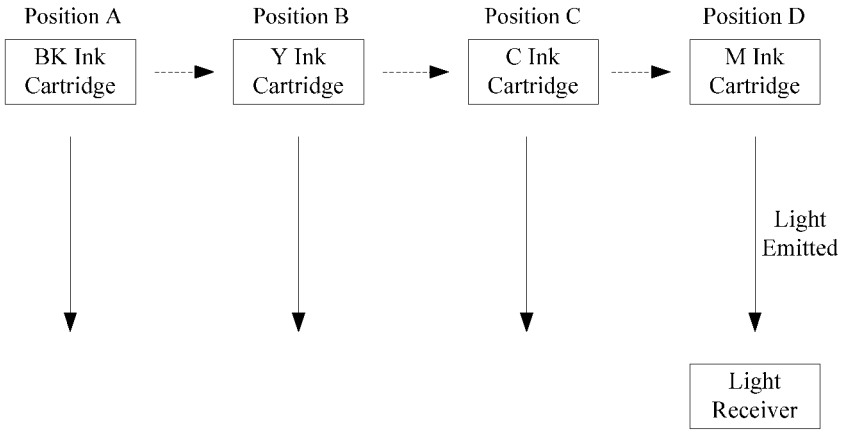
FIG. 8*a* is a schematic diagram 3 illustrating the detection principle of the ink cartridge chip in the embodiment of the present invention.

In the embodiment of the present invention, in the case of mounting a plurality of first or second ink cartridges provided by the embodiment of the present invention into the image forming apparatus, the following cases can be observed during the mounting position detection of ink cartridges:

Firstly, an M ink cartridge is directly opposite to the light receiver; the image forming apparatus sends a light control instruction for illuminating the M ink cartridge; at this point, all the ink cartridges are illuminated at the same time and the light is emitted towards the front of the ink cartridges (or guided to the front of the ink cartridges through an optical guide member), as illustrated in FIG. 8*a*. After a period of time longer than the time of the adjacent luminous quantity detection, the image forming apparatus sends a light-off instruction, all the ink cartridges are turned off at the same time. As the directly opposite position detection is performed at this point, the luminous quantity received by the light receiver satisfies the condition and the ink cartridge is correctly mounted. As seen from the description of the above embodiments, the illuminating flag of the M ink cartridge subjected to the directly opposition position detection is changed to indicate the non-executable state.

Figure 8B:
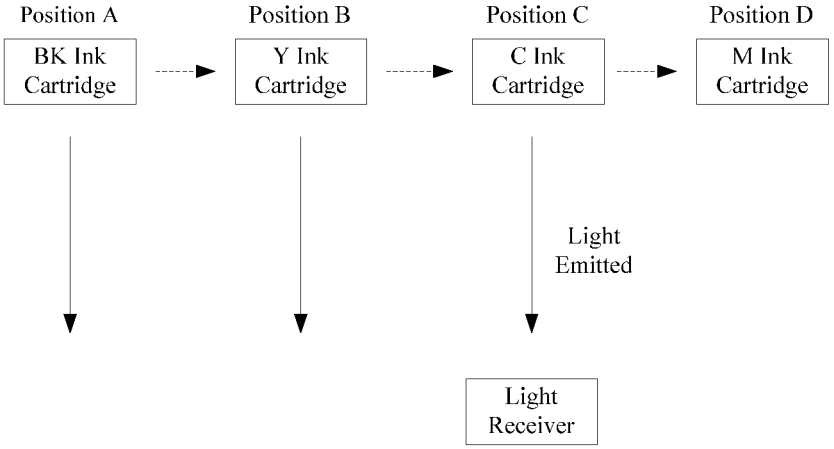
FIG. 8*b* is a schematic diagram 4 illustrating the detection principle of the ink cartridge chip in the embodiment of the present invention.

Secondly, a carriage drives a plurality of ink cartridges to move together so that a C ink cartridge is directly opposite to the light receiver. At this point, the image forming apparatus sends a light control instruction for illuminating the C ink cartridge. As the illuminating flag of the M ink cartridge is changed to indicate the non-executable state, all the other ink cartridges except the M ink cartridge are illuminated, as illustrated in FIG. 8*b*. After a period of time longer than the time of the adjacent luminous quantity detection, the image forming apparatus sends a light-off instruction and the illuminated ink cartridges are turned off at the same time. As the directly opposite position detection is performed at this point, the luminous quantity received by the light receiver satisfies the condition and the ink cartridge is correctly mounted. As seen from the description of the above embodiments, the illuminating flag of the C ink cartridge subjected to the directly opposite position detection is changed to indicate the non-executable state.

Figure 8C:
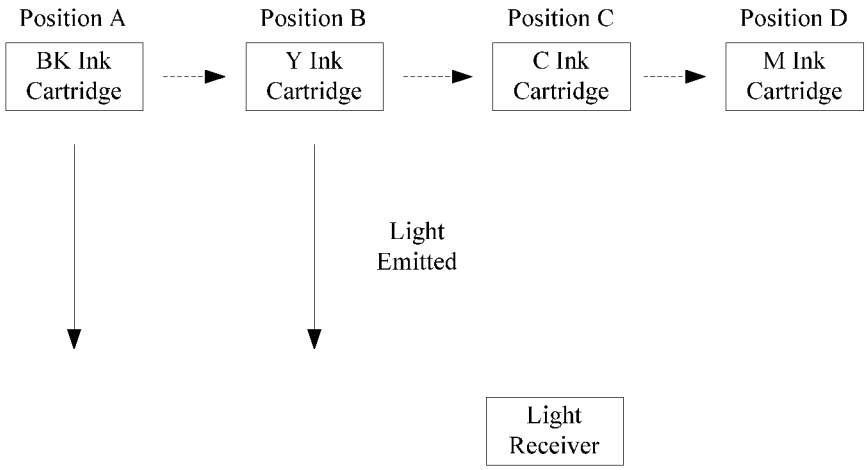
FIG. 8*c* is a schematic diagram 5 illustrating the detection principle of the ink cartridge chip in the embodiment of the present invention.

Thirdly, the carriage is kept still; the adjacent luminous quantity detection is performed on an adjacent ink cartridge of the C ink cartridge; and the image forming apparatus sends a light control instruction for illuminating the M ink cartridge. As the illuminating flags of the M ink cartridge and the C ink cartridge are changed to indicate the non-executable state, all the other ink cartridges except the M ink cartridge and the C ink cartridge are illuminated, as illustrated in FIG. 8*c*. After a period of time shorter than the time of directly opposite position detection, the image forming apparatus sends a light-off instruction and the illuminated ink cartridges are turned off at the same time. As the adjacent luminous quantity detection of the adjacent ink cartridge is performed at this point, the light receiver does not receive the luminous quantity or only receives a small amount of luminous quantity, so that the adjacent luminous quantity detection requirement is met, and hence the image forming apparatus determines that the ink cartridge is correctly mounted.

As seen from the light-emitting conditions during the position detection, less and less ink cartridges are illuminated at the same time, and only one ink cartridge is illuminated finally.

By adoption of the ink cartridge, the ink cartridge chip and the method for controlling the same, provided by the embodiments of the present invention, partial light emitted by the adjacent ink cartridges during the adjacent luminous quantity detection can be effectively blocked. Therefore, the rate of false alarm of the image forming apparatus can be reduced; the problems generated in the mounting process of the ink cartridges can be reduced; and the user experience can be improved.

As the number of ink cartridges, the placement mode of the ink cartridges, the detection order and the detection method of different image forming apparatuses are not quite similar, the ink cartridge detection conditions as described above are only illustrative for example and should not be construed to limit the applicable scope of the present invention.

Figure 9:
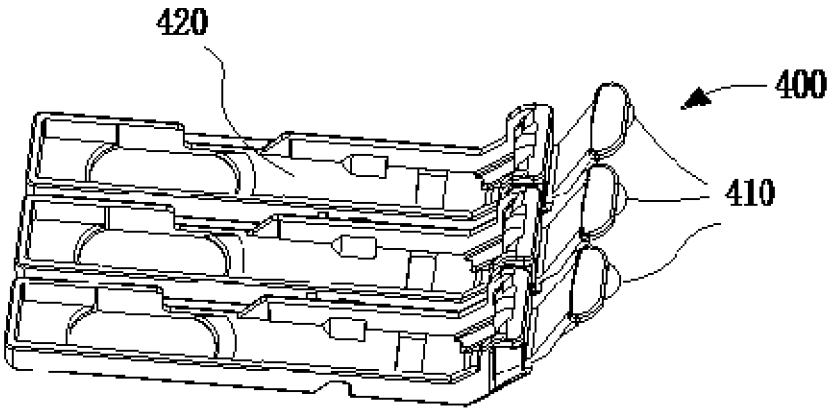
FIG. 9 is a schematic structural view 2 of the ink cartridge chip in the embodiment of the present invention.

It is to be understood by those skilled in the art that the mode of one control unit controlling a plurality of light-emitting units may be also adopted in the above embodiments. More specifically, as illustrated in FIG. 9, the control unit, the storage unit and a plurality of the light-emitting units may be arranged on an adapter 400. The adapter 400 is disposed between the ink cartridges and the main body for the image forming apparatus and a plurality of spaces for holding a plurality of the ink cartridges are formed on the adapter 400, namely the adapter 400 is mounted on the main body for the image forming apparatus at first and then a plurality of the ink cartridges are mounted on the adapter 400. At this point, a plurality of the light-emitting units 410 correspond to a plurality of the ink cartridges mounted one by one. As for an ink cartridge adapter adopting the method for controlling the first or second ink cartridge chip, the ink cartridge adapter may be provided with a storage unit in which various types of ink cartridge identification information are stored. Moreover, a plurality of illumination marking units with the same number with the ink cartridges are arranged on the adapter and correspond to various types of ink cartridge identification information and various light-emitting units one by one. As for an ink cartridge adapter adopting the method for controlling the third, fourth or fifth ink cartridge chip, the ink cartridge adapter may be provided with an instruction receiving statistical unit or an instruction logic recording unit and a plurality of light-emitting units. As the light-emitting rules of the light-emitting units are consistent, a light-emitting unit and a light splitter may be also arranged to replace a plurality of the light-emitting units. As such, the ink cartridge is not required to be provided with a control unit and a light-emitting unit and is only required to be provided with a storage unit for storing related information of the ink cartridge so as to perform data transmission or read-write operation with the main body for the image forming apparatus. Moreover, It is to be understood by those skilled in the art that a plurality of the light-emitting units are respectively arranged on a plurality of the ink cartridges in the above technical proposals, and the control unit arranged on the adapter may be used for controlling the light-emitting units according to the light control instructions sent by the main body of the image forming apparatus only by being connected with a plurality of the ink cartridges through the interface unit.

Figure 10:
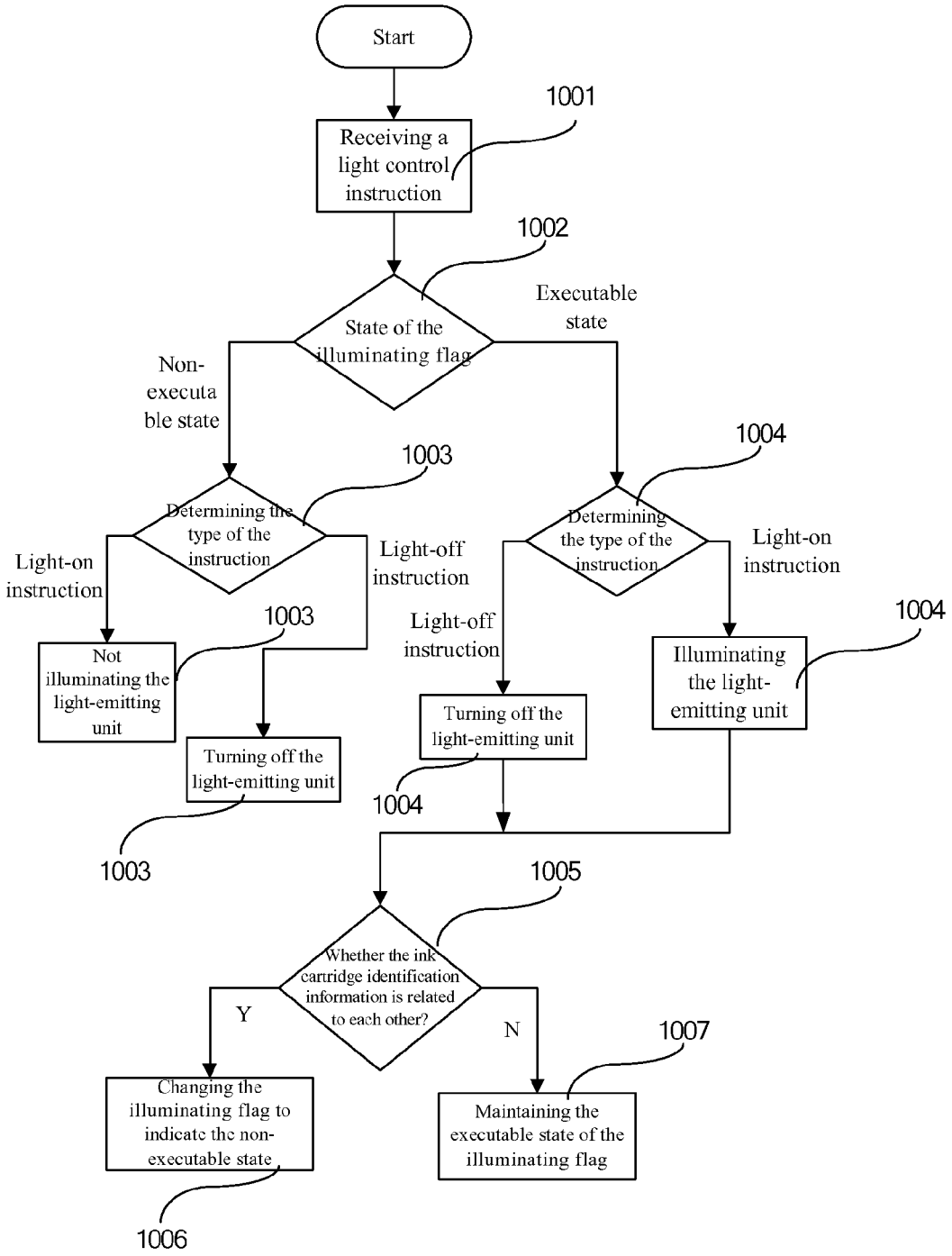
FIG. 10 is a flow diagram 4 of the method for controlling the ink cartridge chip in the embodiment of the present invention.

Correspondingly, in the embodiments of the present invention, the control method includes the steps of: firstly, executing the determination of a light control instruction; secondly, determining the state of an illuminating flag; and thirdly, illuminating or turning off the light-emitting unit or maintaining the initial state of the light-emitting unit. It is to be understood by those skilled in the art that in the flow of the above method, the sequence of partial steps may be exchanged without affecting the technical effects of the present invention. As illustrated in FIG. 10, the main point is that the step of determining the state of the illuminating flag and the step of determining the control information of the light control instruction are exchanged.

As illustrated in FIG. 10, the method includes the following steps of:

step 1001: receiving a light control instruction sent by an image forming apparatus;

step 1002: determining whether an illuminating flag is in the non-executable state, executing step 1003 if so, and executing step 1004 if not;

step 1003: determining the type of the light control instruction, not illuminating a light-emitting unit if the light control instruction is a light-on instruction, and executing the operation of turning off the light-emitting unit if the light control instruction is a light-off instruction; and step 1004: determining the type of the light control instruction, illuminating the light-emitting unit in the case of the light-on instruction, and executing the operation of turning off the light-emitting unit in the case of the light-off instruction.

In the embodiment of the present invention, controlling to change or maintain the state of the illuminating flag according to the determination whether the predetermined triggering conditions can be satisfied.

Controlling to illuminate or turn off the light-emitting unit according to the control information in the light control instruction when determining that the illuminating flag is in the initial executable state.

Controlling to turn off the light-emitting unit when the light-off instruction is received after determining that the illuminating flag indicates the non-executable state. Of course, if the initial state is the off state, the initial off state is maintained; And controlling not to execute the operation of illuminating the light-emitting unit when the light-on instruction is received. That is to say, when the light control instruction is received, the control unit determines the state of the illuminating flag at first and hence may directly turn off the light-emitting unit or maintain the off state of the light-emitting unit without considering the content of the light control instruction, besides executing according to the above modes, if the illuminating flag is already in the non-executable state.

Alternatively, the control unit locks the ink cartridge chip and does not receive or process any light-off instruction when determining that the illuminating flag indicates the non-executable state. In this case, a light-on timer unit may be arranged and begins timer when the light-emitting unit is illuminated, and the light-emitting unit is automatically turned off when the timing time of the light-on timer unit reaches a default value. As such, the light-emitting unit may also be turned off even when the ink cartridge chip is locked as the illuminating flag is changed to indicate the non-executable state when the light-emitting unit is illuminated. Moreover, in order to achieve different illumination durations for different ink cartridge chips, light-on timer units with different timer durations may be arranged on different ink cartridge chips. Alternatively, a capacitor may be arranged on an individual ink cartridge chip. When the timing time of the light-on timer unit reaches the default value, the control unit stops supplying power for the light-emitting unit. However, as the capacitor may continue to supply power for the light-emitting unit, the illumination duration of the light-emitting unit is longer.

After the step of executing the operation of illuminating or turning off the light-emitting unit or maintaining the off state of the light-emitting state, the method determines whether the predetermined triggering conditions can be satisfied and hence changes or not change the state of the illuminating flag. As for which predetermined triggering conditions are based, see the detailed description in various embodiments. No further description will be given herein.

Step 1005: moreover, determining whether the ink cartridge identification information is related to each other, executing step 1006 if so, and executing step 1007 if not;

Step 1006: changing the illuminating flag to indicate the non-executable state; and Step 1007: maintaining the illuminating flag to indicate the executable state.

In various embodiments of the present invention, when the light-on instruction is received, the ink cartridge chip must determine whether the condition is satisfied before emitting light, and meanwhile, whether to emit light the next time must be determined after the determination. That is to say, two conditions must be determined. In one embodiment, the ink cartridge chip may emit light without condition determination when receiving the light-on instruction, and only needs to determine whether to emit light the next time after receiving the light-on instruction. That is to say, only one condition must be determined. More specifically, the present invention provides an ink cartridge chip, which includes an interface unit and a control unit, wherein the interface unit is electrically connected to an image forming apparatus and used for receiving a light control instruction sent by the image forming apparatus, in which the light control instruction includes a light-on instruction used for indicating the illumination of a light-emitting unit on the ink cartridge chip; and the control unit is used for executing the light control instruction when the interface unit receives the light control instruction, and updating the state of the ink cartridge chip according to the light control instruction.

The state of the ink cartridge chip may include a locked state and an unlocked state. If the ink cartridge chip is in the locked state, the control unit does not receive or execute the light control instruction.

In the preferred embodiments of the present invention, the basic detection principles are consistent with those in the above embodiment and will not be described further herein.

The ink cartridge chip provided by the embodiment of the present invention may further include:

a second storage unit used for storing ink cartridge identification information; and a lock marking unit provided with a lock flag used for indicating whether the control unit receives or responds to the next light control instruction; wherein, the control unit may also be used for changing the state of the lock flag according to the predetermined locking condition.

More specifically, the locking condition in the embodiment may be that: the control unit is used for changing the lock flag to indicate the locked state when the ink cartridge identification information in the received light-on instruction or the received light-off instruction is related to the ink cartridge information stored into the second storage unit.

The lock flag includes a locked state and an unlocked state. In the case of the locked state, the ink cartridge chip is in the disabled state and does not receive and respond to any light control instruction. In the case of the unlocked state, the ink cartridge chip receives and responds to any light control instruction.

If the chip is locked after receiving the light-on instruction, the light-emitting unit of the chip is illuminated and will be automatically turned off after a period of pre-scheduled time. More specifically, a charging module (such as a capacitor) with proper capacity or a timer with proper duration may be arranged on the chip to control the power supply time of the light-emitting unit according to the requirement of the illumination duration. If the chip is locked after receiving the light-off instruction, the chip may not be illuminated again.

The locked state of the lock flag restores the unlocked state when the ink cartridge chip receives the power supplied by the image forming apparatus each time or when the image forming apparatus stops supplying power for the ink cartridge chip.

In another embodiment, the ink cartridge chip may further include:

an illumination frequency recording unit used for counting the frequency of illuminating the light-emitting unit; and a lock marking unit provided with a lock flag used for indicating the control unit whether to receive or respond to the next light control instruction; wherein, the control unit is used for controlling the illumination of the light-emitting unit when receiving the light-on instruction, and changing the state of the lock flag according to the predetermined locking condition.

More specifically, the locking condition may be that: the control unit changes the lock flag to indicate the locked state when determining that the frequency of the ink cartridge chip to be illuminated reaches a default value. The statistics of the frequency of the ink cartridge chip to be illuminated may be based on various kinds of information: one is for the statistics of the frequency of light-on instructions received by the ink cartridge chip; one is for the statistics of the frequency of light-off instructions received by the ink cartridge chip; and one is for the statistics of the frequency of light control instructions received by the ink cartridge chip. In particular, the statistics of the illumination frequency may adopt the addition mode with one plus one in turn, and may also adopt the subtraction mode with the received instructions marked one by one, which is similar to the method adopted by the instruction receiving statistical unit in the foregoing embodiments.

As for ink cartridge chips mounted on different types of ink cartridges, the illumination frequency set for locking the lock flag may be different from each other and set as required.

In the embodiment, the illumination frequency recording unit is used for counting the frequency of the light-emitting unit to be illuminated. The illumination frequency recording unit or the lock marking unit may be independently arranged and may also be arranged inside the control unit or the storage unit. The frequency of the light-emitting unit to be illuminated is removed when the ink cartridge chip receives the power supplied by the image forming apparatus each time or when the image forming apparatus stops supplying power for the ink cartridge chip. The locked state of the lock flag restores the unlocked state when the ink cartridge chip receives the power supplied by the image forming apparatus each time or when the image forming apparatus stops supplying power for the ink cartridge chip.

In a third embodiment, the ink cartridge chip may further include:

an instruction logic recording unit used for storing the receiving logics of different light control instructions; and a lock marking unit provided with a lock flag used for indicating the control unit whether to receive or respond to the next light control instruction; wherein, the control unit is used for controlling the illumination of the light-emitting unit when receiving the light-on instruction, and changing the state of the lock flag according to the predetermined locking condition.

More specifically, the locking condition may be that: the control unit changes the lock flag to indicate the locked state when determining that the successively received light control instructions are in conformity with the receiving logics stored into the instruction logic recording unit.

More specifically, supposing that there are four light control instructions, namely BK-ON, C-ON, M-ON and Y-ON, sent by the printer, the logics can be set that the change condition can be satisfied when the ink cartridge chip receives the C-ON instruction and the M-ON instruction in succession. Alternatively, different settings are provided in various different ink cartridge chips, and the change condition can be satisfied when the light control instructions indicating "on first and off then", for example, C-ON and C-OFF, are accumulatively received. Alternatively, different settings are provided in various different ink cartridge chips, and the change condition can be satisfied when the ink cartridge chip receives the Nth light control instruction of certain ink cartridge chip, for example, when the third BK-ON instruction is received.

In the embodiment of the present invention, the instruction logic recording unit may be used for storing the receiving logics of different light control instructions. The instruction logic recording unit may be independently arranged and may also be arranged inside the control unit. The stored receiving logics of the light control instructions are removed when the ink cartridge chip receives the power supplied by the image forming apparatus each time, or when the image forming apparatus stops supplying power for the ink cartridge chip, or when the ink cartridge chip receives light control instructions with specified ink cartridge identification information. The lock marking unit may be arranged independently and may also be arranged inside the control unit. The removing mode of the locked state of the lock marking unit is similar to that of the foregoing embodiments and will not be described in detail herein.

It is to be understood by those skilled in the art that: all or part of the steps for implementing the embodiments of various methods may be implemented through hardware related to program instructions. The programs may be stored into a computer-readable storage medium, and execute the steps in the embodiments of various methods during the execution. Moreover, the storage medium may be a read-only memory (ROM), a random access memory (RAM), a disk, a compact disc (CD) or any medium capable of storing program codes.

It should be finally noted that the foregoing embodiments are only illustrative of the technical proposals of the present invention and are not construed as limiting thereof. Although the present invention has been described in detail with reference to the foregoing embodiments, it should be understood by those skilled in the art that modifications may be still made to the technical proposals illustrated in the foregoing embodiments, or equivalent replacements may be made to part or all of the technical characteristics, and the modifications or replacements should not allow the essence of corresponding technical proposals to depart from the scope of the technical proposals of various embodiments of the present invention.

What is claimed is:

1. An ink cartridge chip, comprising an interface unit and a control unit, wherein the interface unit is connected to an image forming apparatus and used for receiving a light control instruction sent by the image forming apparatus, the light control instruction comprising a light-on instruction or a light-off instruction, both the light-on instruction and the light-off instruction comprise ink cartridge identification information, and the light-on instruction is used for indicating the illumination of a light-emitting unit connected to the control unit; and the control unit is used for controlling whether to execute the light control instruction according to the state of the ink cartridge chip when the interface unit receives the light control instruction, and updating the state of the ink cartridge chip according to predetermined triggering conditions which relate to the ink cartridge identification information in the light control instruction, wherein the states of the ink cartridge chip comprise an executable state and a non-executable state.

2. The ink cartridge chip according to claim 1, wherein the control unit is used for controlling the illumination of the light-emitting unit if the ink cartridge chip is in the executable state when the interface unit receives the light-on instruction.

3. The ink cartridge chip according to claim 2, wherein the ink cartridge chip further comprises:

a first storage unit used for storing ink cartridge identification information; and an illumination marking unit provided with an illuminating flag used for indicating whether the ink cartridge chip is in the executable state or the non-executable state;

wherein, the control unit is used for illuminating the light-emitting unit according to the light-on instruction when the illuminating flag indicates the executable state, and not executing the light-on instruction when the illuminating flag indicates the non-executable state.

4. The ink cartridge chip according to claim 3, wherein the control unit is used for changing the illuminating flag to indicate the non-executable state when the ink cartridge identification information in the received light-on instruction or the received light-off instruction is related to the ink cartridge identification information stored into the first storage unit;

or the control unit is used for changing the illuminating flag to indicate the non-executable state when the ink cartridge identification information in the received light-on instruction is related to the ink cartridge identification information stored into the first storage unit and the time length between the received light-on instruction and a subsequently received light control instruction is verified to be more than or equal to a first threshold value;

or the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when the time length between the received light-on instruction and a subsequently received light control instruction is verified to be more than or equal to the first threshold value, or else, changing the illuminating flag back to indicate the executable state;

or the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when the time length between a previously received light-off instruction and a subsequently received light-off instruction is verified to be more than or equal to a second threshold value, or else, changing the illuminating flag back to indicate the executable state.

5. The ink cartridge chip according to claim 3, wherein the control unit is used for changing the illuminating flag to indicate the non-executable state when the ink cartridge identification information in two accumulatively received light control instructions is respectively related to the ink cartridge identification information stored into the first storage unit;

or the control unit is used for changing the illuminating flag to indicate the non-executable state when the ink cartridge identification information in two accumulatively received light control instructions is respectively related to the ink cartridge identification information stored into the first storage unit and the time length between the two received light control instructions is more than or equal to the first threshold value;

or the control unit is used for changing the illuminating flag to indicate the non-executable state when the ink cartridge identification information in two accumulatively received light control instructions is respectively related to the ink cartridge identification information stored into the first storage unit and the time length between the second received light control instruction and the previously received light-off instruction is more than or equal to the second threshold value.

6. The ink cartridge chip according to claim 2, wherein the state of the ink cartridge chip is the instruction receiving state of the ink cartridge chip; and the ink cartridge chip further comprises:

an instruction receiving statistical unit used for the statistics of the instruction receiving state of the ink cartridge chip in receiving the light control instruction;

wherein, the control unit is used for controlling whether to execute the light control instruction according to the instruction receiving state when the interface unit receives the light control instruction, and updating the instruction receiving state stored into the instruction receiving statistical unit according to the light control instruction.

7. The ink cartridge chip according to claim 6, wherein the instruction receiving statistical unit is specifically used for storing the received light-on instruction or the ink cartridge identification information in the received light control instruction; and the control unit is used for controlling the illumination of the light-emitting unit when a third threshold value is reached if the same light-on instruction or the same ink cartridge identification information is not recorded in the instruction receiving statistical unit, and not executing the operation of illuminating the light-emitting unit if the same light-on instruction or the same ink cartridge identification information is recorded in the instruction receiving statistical unit, when the light-on instruction is received; and updating the instruction receiving state stored into the instruction receiving statistical unit according to the light control instruction.

8. The ink cartridge chip according to claim 7, wherein the control unit is used for updating the instruction receiving state stored into the instruction receiving statistical unit according to the light control instruction, and more specifically, is used for recording the lately received light-on instruction or the ink cartridge identification information in the previously received light control instruction into the instruction receiving statistical unit when determining that the time length between the two successively received light control instructions is more than or equal to the first threshold value;

or the control unit is used for updating the instruction receiving state stored into the instruction receiving statistical unit according to the light control instruction, and more specifically, is used for storing the light-on instruction or the ink cartridge identification information in the light control instruction into the instruction receiving statistical unit when the received light-on instruction or the received ink cartridge identification information is not recorded in the instruction receiving statistical unit, and maintaining the light-on instruction or the ink cartridge identification information recorded in the instruction receiving statistical unit this time when determining that the time length between the current light control instruction and a subsequently received light control instruction is more than or equal to the first threshold value, or else, deleting the light-on instruction or the ink cartridge identification information recorded this time;

or the control unit is used for updating the instruction receiving state stored into the instruction receiving statistical unit according to the light control instruction, and more specifically, is used for storing the light-on instruction or the ink cartridge identification information in the light control instruction into the instruction receiving statistical unit when the received light-on instruction or the received ink cartridge identification information is not recorded in the instruction receiving statistical unit, and maintaining the light-on instruction or the ink cartridge identification information recorded in the instruction receiving statistical unit this time when determining that the time length between a light-off instruction received before receiving the light-on instruction and a light-off instruction received after receiving the light-on instruction is more than or equal to a second threshold value, or else, deleting the light-on instruction or the ink cartridge identification information recorded this time.

9. The ink cartridge chip according to claim 6, wherein the instruction receiving statistical unit is used for storing marking information respectively corresponding to the light-on instructions or the ink cartridge identification information in the light control instructions; and the control unit is used for controlling the illumination of the light-emitting unit when a third threshold value is reached if the marking information corresponding to the same light-on instruction or the same ink cartridge identification information recorded in the instruction receiving statistical unit is not marked when receiving the light-on instruction, or else, not executing the operation of illuminating the light-emitting unit; and updating the instruction receiving state stored into the instruction receiving statistical unit according to the light control instruction.

10. The ink cartridge chip according to claim 9, wherein the control unit is used for updating the instruction receiving state stored into the instruction receiving statistical unit according to the light control instruction, and more specifically, is used for marking the marking information corresponding to the light-on instruction lately received by the instruction receiving statistical unit or the ink cartridge identification information in the light control instruction previously received by the instruction receiving statistical unit when determining that the time length between the two successively received light control instructions is more than or equal to the first threshold value;

or the control unit is used for updating the instruction receiving state stored into the instruction receiving statistical unit according to the light control instruction, and more specifically, is used for marking the marking information, corresponding to the light-on instruction or the ink cartridge identification information in the light control instruction, in the instruction receiving statistical unit, after receiving a new light-on instruction, and maintaining the marking information, corresponding to the light-on instruction or the ink cartridge identification information in the light control instruction, marked this time, or else, deleting the marking information, corresponding to the light-on instruction or the ink cartridge identification information in the light control instruction, marked this time.

11. The ink cartridge chip according to claim 2, wherein the ink cartridge chip further comprises:

an instruction logic recording unit used for storing receiving logics of different light control instructions; and a light-on state unit provided with a light-on state bit used for indicating whether the ink cartridge chip is in the executable state or the non-executable state;

wherein, the control unit is used for illuminating the light-emitting unit according to the light-on instruction when the light-on state bit indicates the executable state, and not executing the light-on instruction when the light-on state bit indicates the non-executable state, and controlling and changing the state of the light-on state bit according to the receiving logics stored into the instruction logic recording unit.

12. The ink cartridge chip according to claim 11, wherein the control unit is more specifically used for controlling and changing the light-on state bit to indicate the non-executable state when determining that the previously and lately received light control instructions are in conformity with the receiving logics stored into the instruction logic recording unit.

13. An ink cartridge, comprising the ink cartridge chip according to claim 1.

14. An ink cartridge, comprising the ink cartridge chip according to claim 3.

15. An ink cartridge, comprising the ink cartridge chip according to claim 4.

16. An ink cartridge, comprising the ink cartridge chip according to claim 5.

17. An ink cartridge, comprising the ink cartridge chip according to claim 6.

18. An ink cartridge, comprising the ink cartridge chip according to claim 7.

19. An ink cartridge, comprising the ink cartridge chip according to claim 8.

20. An ink cartridge, comprising the ink cartridge chip according to claim 9.

21. An ink cartridge, comprising the ink cartridge chip according to claim 10.

22. An ink cartridge, comprising the ink cartridge chip according to claim 11.

23. An ink cartridge, comprising the ink cartridge chip according to claim 12.

24. A method for controlling an ink cartridge chip, comprising the following steps of:

receiving a light control instruction sent by an image forming apparatus, the light control instruction comprising a light-on instruction or a light-off instruction, both the light-on instruction and the light-off instruction comprise ink cartridge identification information, and the light-on instruction is used for indicating the illumination of a light-emitting unit on the ink cartridge chip; and controlling whether to execute the light control instruction according to the state of the ink cartridge chip when receiving the light control instruction; and updating the state of the ink cartridge chip according to predetermined triggering conditions which relate to the ink cartridge identification information in the light control instruction;

wherein, the states of the ink cartridge chip comprise an executable state and a non-executable state, and the light-emitting unit is controlled to be illuminated if the ink cartridge chip is in the executable state when the light-on instruction is received.

25. An ink cartridge chip, comprising an interface unit and a control unit, wherein the interface unit is connected to an image forming apparatus and used for receiving a light control instruction sent by the image forming apparatus, the light control instruction comprising a light-on instruction or a light-off instruction, and the light-on instruction is used for indicating the illumination of a light-emitting unit connected to the control unit; and the control unit is used for controlling whether to execute the light control instruction according to the state of the ink cartridge chip when the interface unit receives the light control instruction, and updating the state of the ink cartridge chip according to the light control instruction; wherein both the light-on instruction and the light-off instruction comprise ink cartridge identification information; and the control unit is used for changing the illuminating flag to indicate the non-executable state when the ink cartridge identification information in the received light-on instruction or the received light-off instruction is related to the ink cartridge identification information stored into the first storage unit; or the control unit is used for changing the illuminating flag to indicate the non-executable state when the ink cartridge identification information in the received light-on instruction is related to the ink cartridge identification information stored into the first storage unit and the time length between the received light-on instruction and a subsequently received light control instruction is verified to be more than or equal to a first threshold value; or the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when the time length between the received light-on instruction and a subsequently received light control instruction is verified to be more than or equal to the first threshold value, or else, changing the illuminating flag back to indicate the executable state; or the control unit is used for changing the illuminating flag to indicate the non-executable state when the ink cartridge identification information in the received light-on instruction is related to the ink cartridge identification information stored into the first storage unit, and maintaining the illuminating flag to indicate the non-executable state when the time length between a previously received light-off instruction and a subsequently received light-off instruction is verified to be more than or equal to a second threshold value, or else, changing the illuminating flag back to indicate the executable state.

* * * * *